United States Patent [19]

Warren et al.

[11] Patent Number: 4,631,005

[45] Date of Patent: Dec. 23, 1986

[54] INPUT TORQUE CONTROL DEVICE

[76] Inventors: Gerald K. Warren, Rosenweg 15,, D-6382 Friedrichsdort; Raffaele Sandroni, Gartenfeldstrasse 40E, D-6380 Bad Homburg, both of Fed. Rep. of Germany

[21] Appl. No.: 786,791

[22] Filed: Oct. 11, 1985

[30] Foreign Application Priority Data

Aug. 17, 1985 [EP] European Pat. Off. ..... 85110318.4

[51] Int. Cl.[4] ..... F04B 1/26

[52] U.S. Cl. ..... 417/218; 417/222

[58] Field of Search ..... 417/212, 218, 222; 62/445

[56] References Cited

U.S. PATENT DOCUMENTS

| | | | |
|---|---|---|---|
| 3,723,026 | 3/1973 | Soyland | 417/222 |
| 3,742,820 | 7/1973 | Lonnemo | 91/497 |
| 3,758,235 | 9/1973 | Breeden | 417/222 |
| 3,784,327 | 1/1974 | Lonnemo | 417/222 |
| 4,203,712 | 5/1980 | Uehara | 417/218 |

FOREIGN PATENT DOCUMENTS

| | | | |
|---|---|---|---|
| 47810 | 10/1978 | Japan | 417/216 |
| 48105 | 5/1981 | Japan | 417/212 |

*Primary Examiner*—William L. Freeh

*Attorney, Agent, or Firm*—Barnes, Kisselle, Raisch, Choate, Whittemore & Hulbert

[57] ABSTRACT

In a control device for limiting the maximum permissible input torque or power for a hydraulic pump, a control valve is provided with a first piston area which is acted upon by pressure from a torque sensor. A second piston area effective to more the control valve against a return means is acted upon by pressure from a remote control device so as to reduce the maximum possible input torque and thus create an input torque control device also effective as a power preselecting device.

13 Claims, 5 Drawing Figures

INPUT TORQUE CONTROL DEVICE

BACKGROUND OF INVENTION

The invention relates to power transmissions and particularly to a control device to adjust the input torque of a hydraulic variable displacement pump.

In U.S. Pat. No. 3,742,820 to Lonnemo, input torque of a hydraulic variable displacement pump is limited, where the return spring of the control valve (or compensator) is manually set on a preload which determines the pressure limit of the control device. Since the compensator is mounted on or near to the pump casing, such setting is not by a remote control device.

It is sometimes advantageous with machines not to use the full drive power, but to limit the drive energy to the amount required at that time. The obvious result in a reduction in power consumption.

SUMMARY OF INVENTION

It is an object of the present invention to provide a control device for adjusting the input torque of a variable displacement pump.

It is a further object of the present invention to provide a control device which can be comfortably adjusted and remotely controlled by an operator from an operating cab to the particular level required at that moment.

The invention comprises a remote control device adapted to deliver a remote control pressure signal to a control piston means to act on the compensator or control valve against the effect of the return means.

The remote control device can be constructed hydromechanically or hydroelectrically. With the hydroelectrical version in particular it is possible to process and take into consideration additional conditioning signals from the motor and machine, in order to satisfy the numerous special requirements of each particular user. Two areas of application are discussed in the following paragraphs.

When concrete has to be conveyed using a concrete pump then it is best to adjust the output of the concrete being delivered to the building site, i.e. the quantity and speed of flow, according to the local conditions. The flow rate of the concrete depends on the amount to be conveyed and the friction of the concrete, which again depends on the length of the supply pipe and the consistency of the concrete. To achieve an optimal delivery it is necessary to have an adjustable drive to regulate the output. With the control device according to invention it is possible to adjust the torque limit variable thus allowing the concrete pump to function optimally.

Recently more attention has been paid to energy conservation in excavators, probably in the form of power requirement pre-selection. Pre-selecting the pump input torque could be one of the simplest ways of adjusting the power requirement.

The remote control device can be constructed as an electro-hydraulic servo valve, which can be controlled by hand or automatically by electronics, allowing further parameters to be taken into consideration. If only a few pre-selected input torques are wished to be regulated then the remote control device can also be constructed as an arrangement of pressure-reducing valves.

The control valve can be of a normal compensator construction where an additional auxiliary piston is installed to act upon the compensator spool, where the control piston means can be adapted to requirements by selecting the diameter ratio between compensator spool and auxiliary piston.

BRIEF DESCRIPTION OF THE DRAWINGS

Further objects and advantages of the present invention will be apparent from the following description reference being made to the accompanying drawings, in which.

DESCRIPTION OF THE PREFERRED EMBODIMENTS

Figure 1:
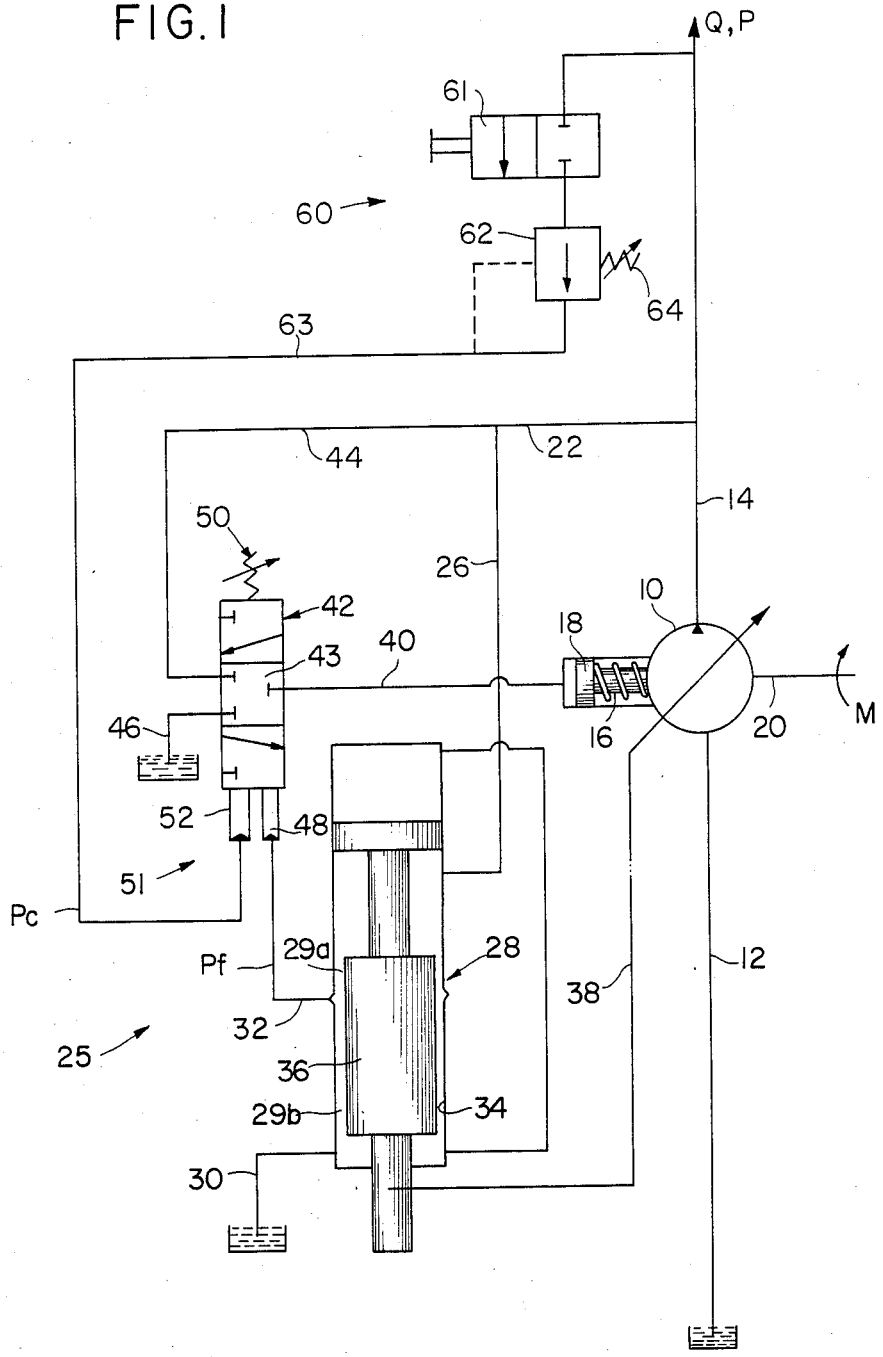
FIG. 1 is a first embodiment of the control device.
Figure 2:
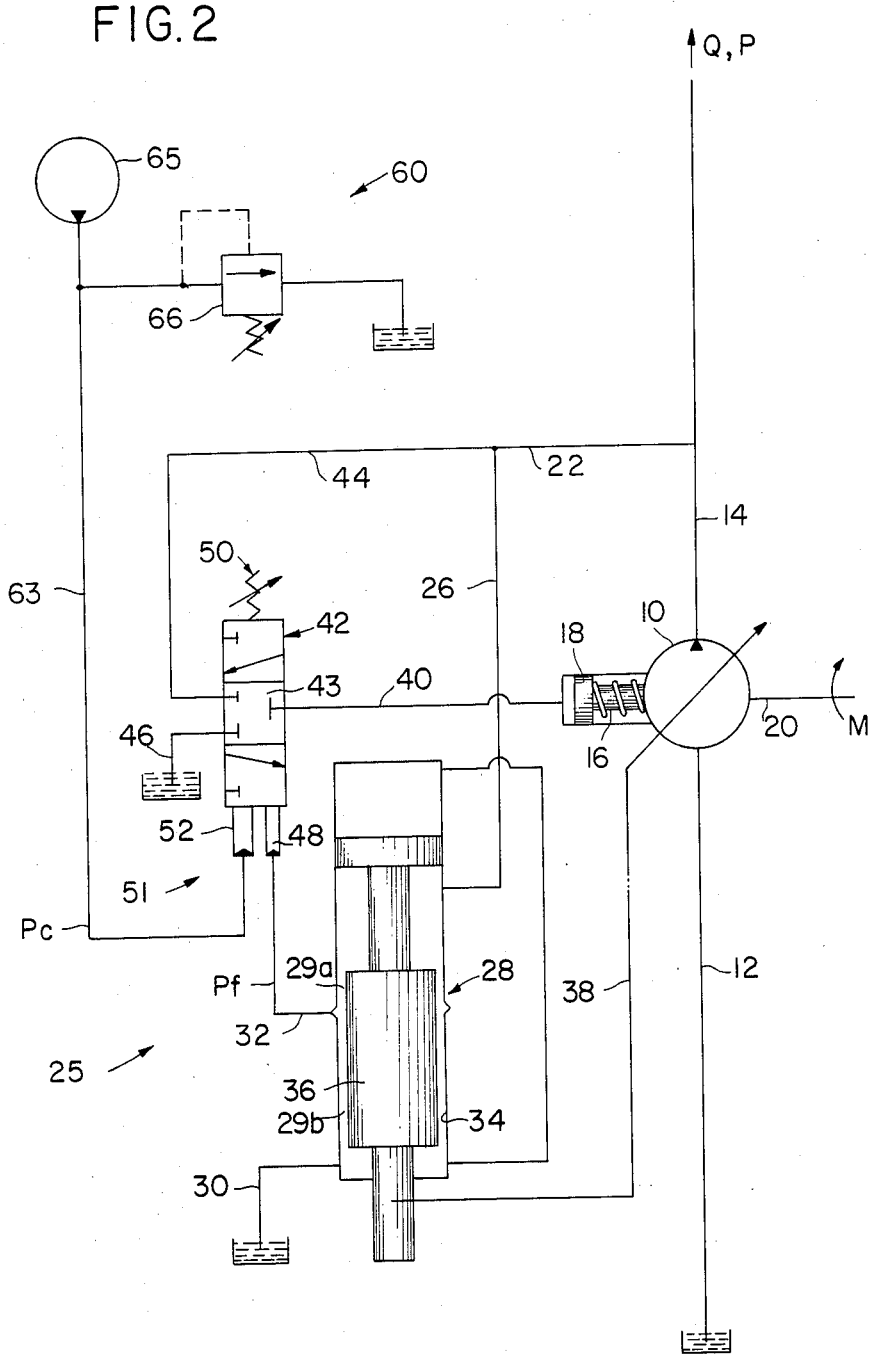
FIG. 2 is a second embodiment.

Referring to FIGS. 1 and 2, a hydraulic variable displacement pump 10 with a single flow direction is connected to an inlet line 12 and an outlet line 14 which delivers flow Q at pressure P. The pump 10 has a displacement varying device 16 including a servomotor f.i. a cylinder 18 which is biased by a spring or returned hydraulically. The pump 10 is driven over a drive shaft by a motor, which is not shown, and which produces the required input torque M within certain limits.

The outlet line 14 has a branch 22 to supply a control pressure circuit 25. The control pressure circuit 25 includes a torque sensor 28 consisting of a pair of variable laminar restrictors 29*a* and *b*, which are connected in series to a drain circuit formed by lines 26, 30. A pressure feedback line 32 is connected to the junction of the laminar restrictors 29*a* and *b*, each being formed by a thin flow space between a long cylinder 34 and a plunger 36. The plunger 36 is mechanically connected to the displacement varying device 16 as indicated by an effective line 38. When the pump displacement 10 is reduced, the plunger 36 is shifted so as to reduce the resistance of the laminar restrictor 29*a* and to increase the resistance of the restrictor 29*b*.

The control pressure circuit 25 also has a control valve 42 frequently characterised as a compensator. The control valve 42 can be formed as a throttling three-way directional valve having three ports. The first port is connected by a branch line 44 to the branch line 22, whilst the second port is connected by a control line 40 to the cylinder 18, and the third port leads to tank via a drain line 46. The control valve 42 has a spool 43 which is acted upon, in one direction, by a return means 50 and, in the other direction, by a control piston means 51. In the illustrated embodiment, the return means 50 consists of manually adjustable valve spring. The control piston means 51 includes a first piston 48 which is connected by line 32 to the torque sensor 28 and acts against the bias of the return spring 50.

The pump 10 in operation delivers the fluid through the outlet line 14 against variable pressure and at the variable volume absorption capacity (requirement on the flow) of the consumer. Since line 32 is connected to the outlet line 14 by way of the drain line circuit 22, 26, 30, the pressure $P_f$ in line 32 depends on the level of the pump pressure in line 14 and on the ratio a/b of the resistances of the laminar restrictors a and b to each other. Since plunger 36 is connected to the displacement varying device 16, the ratio a/b of the resistances changes with the displacement adjustment of the pump 10. The pressure $P_f$ in line 32 is therefore proportional to the product of the displacement and the pump pressure. Providing that the drive motor of pump 10 is running at a constant speed, each pump flow Q in line 14 corresponds to each displacement position of the pump 10. The pressure $P_f$ in line 32 is then also proportional to the pump power, which results from the product of the pump pressure P and the flow Q.

By varying the return device 50, i.e. by correspondingly adjusting the bias of the valve spring, the cracking or switching pressure of the control valve 42 can be preset, where fluid begins to flow into the control line 40. Every adjustment of the valve spring brings with it a corresponding maximum pump power setting. Each maximum pump power setting can be represented by a hyperbole in a pressure flow diagram i.e. operation points of a power controlled pump can occur in the particular field between the coordinate axis and the particular hyperbole.

Figure 4:
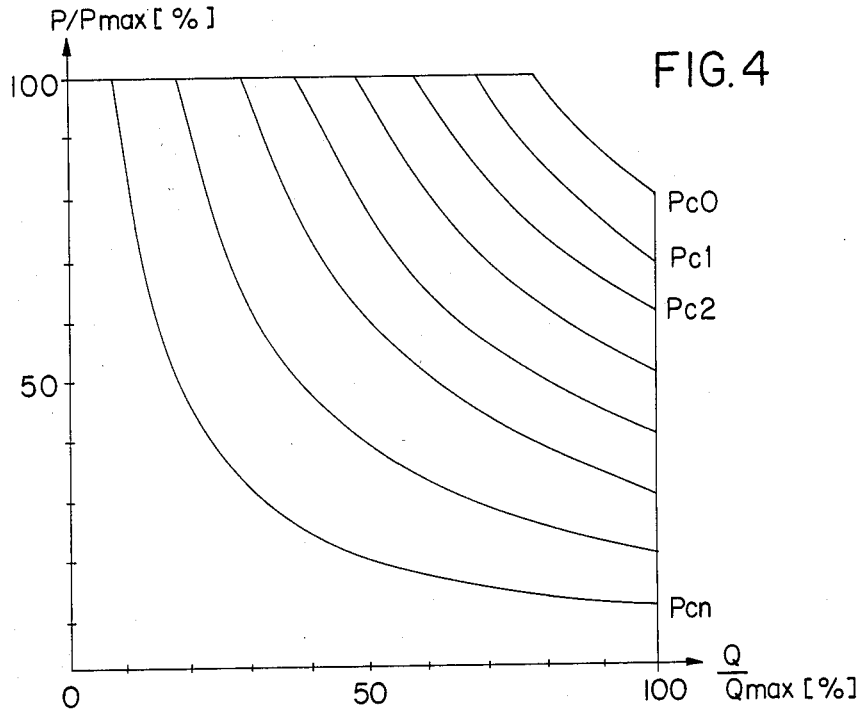
FIG. 4 is a schematic diagram of the pump pressure P plotted against the flow Q for remote control pressures $P_{co} \ldots P_{cn}$.
Figure 5:
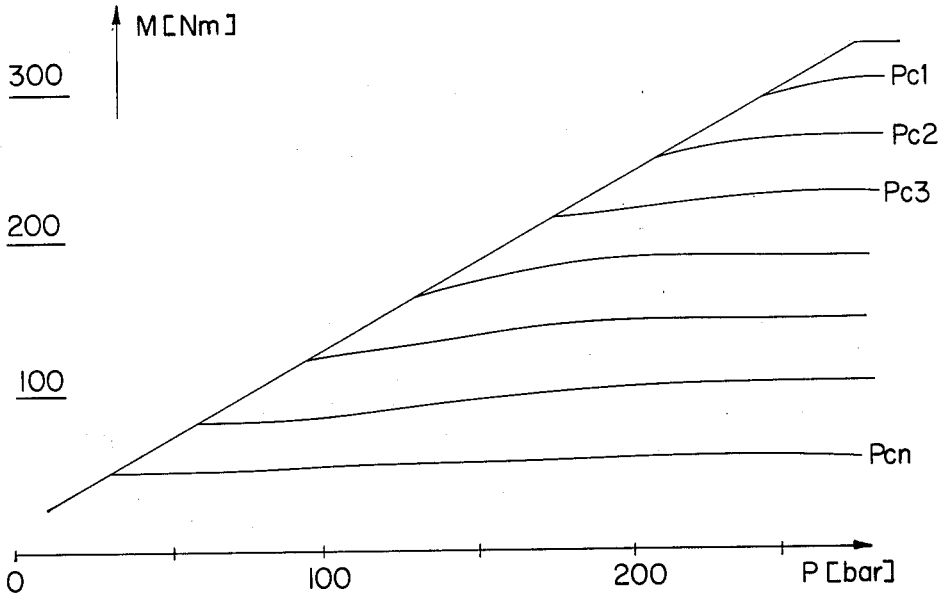
FIG. 5 is a diagram of the input torque M plotted against the pump pressure P for remote control pressures $P_{co} \ldots P_{cn}$.

Power limitation also means limiting the input torque, since power can also be calculated by multiplying the input torque by the speed. Accordingly, each hyperbole in FIG. 4 is coordinated to a certain input torque in FIG. 5.

With the existing control device according to U.S. Pat. No. 3,742,820 to Lonnemo it is only possible to effectively select one of the hyberbolic limitation curves. Therefore the device was used as a protection against overloading, whilst with the invention a quick change-over between a plurality of power levels is intended.

The control device according to invention differs from the old in the construction of the control piston device 51 and in that a remote control device 60 is provided.

In FIG. 1 the remote control device 60 consists of a shut-off valve 61 and a pressure reducing valve 62, which are arranged in series in a remote control line 63 connected to the outlet line and which leads to the control piston means 51. The output or control pressure $P_c$ of the pressure reducing valve 62 can be preset by adjusting the bias of the valve spring 64 manually.

If several input torques are to be preselected quickly one after the other at the shaft 20, then a plurality of pressure reducing valves 62 is provided, each producing a different control pressure $P_{c1} \ldots P_{cn}$ and each can be momentarily made effective by a corresponding multi-directional valve. Instead of the shut-off valve 61 illustrated with two ports and two positions as well as hand-operated, both electrical or hydraulically controlled devices can of course be used in connection with pressure control valves.

The control piston means 51 also shows, conforming to invention, besides the already described first piston 48, a second additional piston 52 which is loaded from the control pressure $P_c$ and which acts in the same way as the first piston 48 against the force of the return means. The control pressure $P_c$ accordingly represents a remote control signal whereby the cracking point and switching of the control valve 42 is reached earlier compared with the device of Lonnemo (U.S. Pat. No. 3,742,820) and the torque at the shaft 20 is reduced accordingly.

Referring to FIG. 2, the remote control signal $P_c$ is prepared in a different way, from a pilot pump, and with the aid of at least one pressure relief valve 66. If the torque is to be varied quickly, a plurality of pressure relief valves 66 is provided in parallel, one of them being connected to the remote control line 63 through a selector valve (corresponding to the shut-off valve 61 in FIG. 1) and defining the required remote control signal $P_c$. The relief valve 66 can be a hydromechanically operated one or an electrohydraulically operated one.

If, as illustrated in FIGS. 1 and 2, two pistons 48, 52 are positioned beside each other, then a range for example from 80 to 10% of the maximum torque can be present by remote control.

Figure 3:
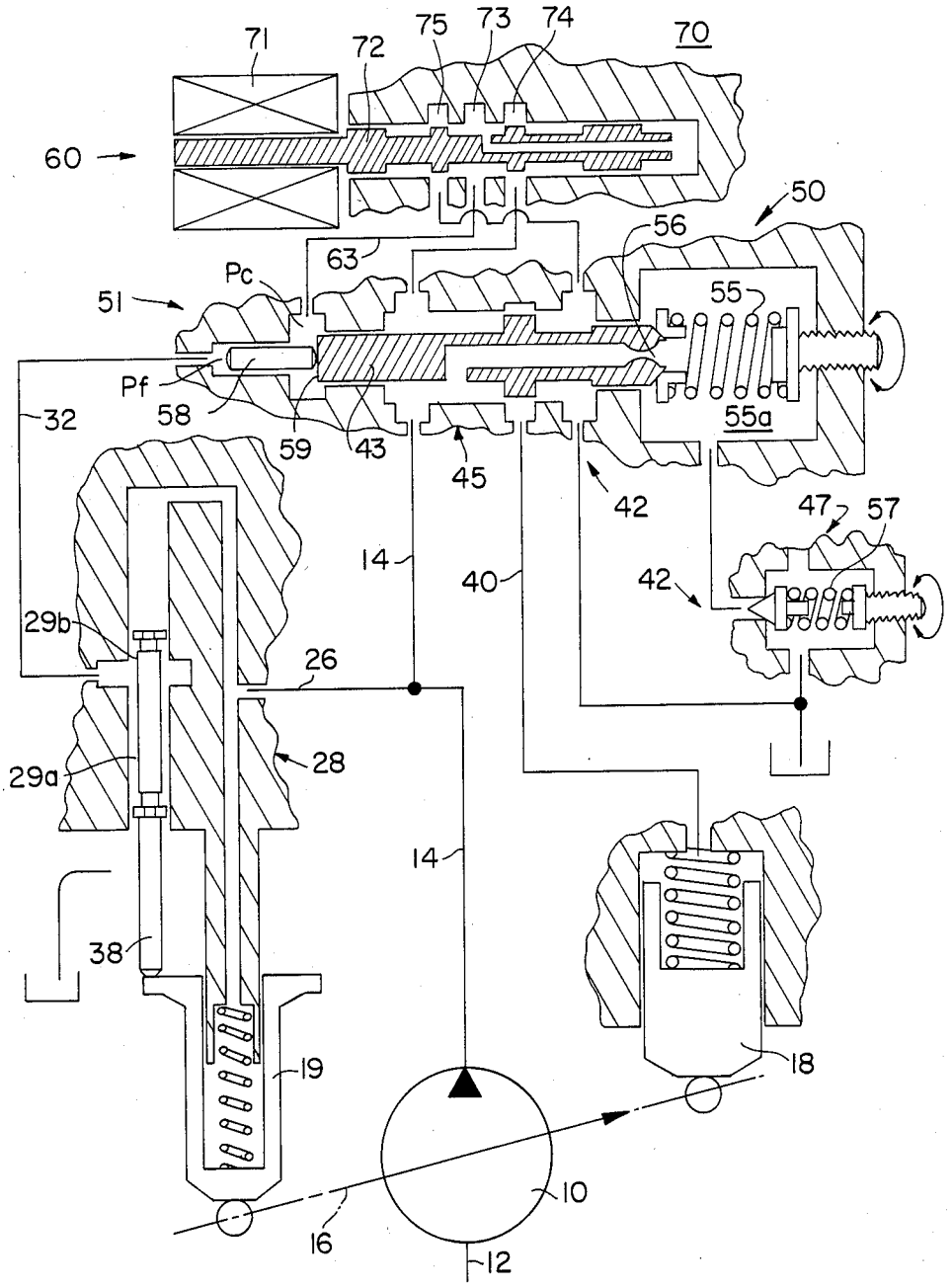
FIG. 3 is a third embodiment.

FIG. 3 shows an embodiment without this limitation. Furthermore, control valve 42 is pilot-controlled and a proportional pressure-reducing valve 70 as a remote control device 60 is used.

Elements which correspond to those in FIG. 1 have the same reference members and do not need to be described once more. Instead of a single cylinder, the servo motor has two cylinders 18, 19 to vary the displacement of the pump.

The control valve 42 has a main valve 45 as the first stage and a pilot valve 47 as the second stage. The adjustable return device 50 includes the adjustable valve spring 55 and a throttle orifice 56 whereby the pump pressure is directed to the pilot valve 47 which opens at a certain adjustable minimum pressure of response preset by manually adjustable valve spring 57, so that the pressure in chamber **55*a* of the main valve 45 decreases and the valve spool 43 is displaced to connect lines 14 and 44. The pilot valve 47 returns to its seated position and spool 43 closes line 40 after the displacement varying device 16** has occupied a new position. This well known mode of operation does not need to be investigated further here.

The control piston mechanism 51 has an auxiliary piston 58 with a piston face bordered by the pressure $P_f$ of line 32 and acting on spool 43. Spool 43 has a piston face 59 which is acted upon by pressure $P_c$ in line 63.

The remote control mechanism 60 contains an electrohydraulic servo valve 70, which is constructed as a proportional pressure-reducing valve having three ports. One port 74 is connected to a pressure supply, a second port is connected to the tank and a third port 68 to the line 63. By correspondingly energizing a solenoid 71, the valve spool 72 can be shifted in such a way that a desired pressure $P_c$ is directed via line 63 to the control valve 42 to preselect a desired power setting or a desired input torque.

It can thus be seen that a power limit can be selected from a plurality of power limits to adapt the power transmission to requirements.

What is claimed is:

1. Input torque control device for adjusting the input torque acting on a hydraulic variable displacement pump comprising:

means for changing said pump displacement including hydraulic servo motor means;

control valve means including a spool having a first and a second side which are opposed;

a first control piston means acting on said first side of said spool, an adjustable return means including spring means acting onto said second side of said spool, said control valve means also having a pressure supply port, an output control port and a tank port, said output control port being connected to said servo motor means;

a torque sensor delivering a hydraulic feedback pressure signal indicative of input torque acting onto said variable displacement pump;

said feedback pressure signal acting upon said first control piston means against the action of said return means to move said spool of said control valve means when said pump displacement is being changed;

a remote control device adapted to deliver a further pressure signal showing at least one selective pressure level;

a second control piston means adapted to receive said further pressure signal and being arranged to act onto said first side of said spool against said return means so that said spool is moved to a position indicative of one desired input torque acting onto said variable displacement pump corresponding to said one selective pressure level.

2. Input torque control device set forth in claim 1 comprising a manual control means;

said manual control means being included in said remote control device and being adapted to be actuated at will by hand.

3. Input torque control device set forth in claim 1 wherein said remote control device includes at least one pressure reducing valve.

4. Input torque control device set forth in claim 1 wherein said remote control device includes a proportional pressure-reducing valve.

5. Input torque control device set forth in claim 1 wherein said remote control device includes a relief valve and a pilot pressure source, said pilot pressure source supplying fluid to said relief valve and said control piston means.

6. Input torque control device set forth in claim 5 wherein said relief valve is of a type which is hydromechanically controlled.

7. Input torque control device set forth in claim 5 wherein said relief valve is of a type which is electrohydraulically controlled.

8. Input torque control device for adjusting the input torque acting on a hydraulic variable displacement pump, means for changing said pump displacement including hydraulic servo motor means;

control valve means including a spool having a first and a second side which are opposed;

a first control piston means acting on said first side of said spool, an adjustable return means including spring means acting onto said second side of said spool, said control valve means also having a pressure supply port, an output control port and a tank port, said output control port being connected to said servo motor means;

a torque sensor delivering a hydraulic feedback pressure signal indicated of input torque acting onto said variable displacement pump;

said feedback pressure signal acting upon said first control piston means against the action of said return means to move said spool of said control valve means when said pump displacement is being changed;

a remote control device;

said remote control device comprising an electrohydraulic servo valve having a solenoid which can be energized by selective currents, a pressure supply port, a tank port and an output control port, the latter delivering a further pressure signal assuming one of a plurality of pressure levels corresponding to said exiting current;

a second control piston means acting onto said first side of said spool;

said second control piston means being connected to said output control port so that said spool of said control valve means is moved to a position indicative of one desired input torque acting onto said variable displacement pump.

9. Input torque control device for adjusting the input torque of a hydraulic variable displacement pump comprising:

means for changing said pump displacement including hydraulic servo motor means;

control valve means having an adjustable return means and a control piston means, said control valve being connected to said servo motor means;

a torque sensor delivering a hydraulic feedback pressure signal indicative of input torque and power to said variable displacement pump;

said feedback pressure signal acting upon said control piston means against the action of said return means, to move said control valve means when said pump displacement is being changed;

the improvement wherein said control piston means is adapted to receive a further pressure signal acting against said return means, and further comprising a remote control device adapted to deliver said further pressure signal with a selective pressure level so that said control valve means is moved to a position indicative of a desired input torque to said variable displacement pump;

said remote control device being a electro-hydraulic servo valve.

10. Input torque control device for adjusting the input torque of a hydraulic variable displacement pump comprising:

means for changing said pump displacement including hydraulic servo motor means;

control valve means having an adjustable return means and a control piston means, said control valve being connected to said servo motor means;

a torque sensor delivering a hydraulic feedback pressure signal indicative of input torque and power to said variable displacement pump;

said feedback pressure signal acting upon said control piston means against the action of said return means, to move said control valve means when said pump displacement is being changed;

the improvement wherein said control piston means is adapted to receive a further pressure signal acting against said return means, and further comprising a remote control device adapted to deliver said further pressure signal with a selective pressure level so that said control valve means is moved to a position indicative of a desired input torque to said variable displacement pump, said remote control device including a relief valve and a pilot pressure source, said pilot pressure source supplying fluid to said relief valve and said control piston means;

said relief valve being of a type to be hydromechanically controlled.

11. Input torque control device for adjusting the input torque of a hydraulic variable displacement pump comprising:

means for changing said pump displacement including hydraulic servo motor means;

control valve means having an adjustable return means and a control piston means, said control valve being connected to said servo motor means;

a torque sensor delivering a hydraulic feedback pressure signal indicative of input torque and power to said variable displacement pump;

said feedback pressure signal acting upon said control piston means against the action of said return means, to move said control valve means when said pump displacement is being changed;

the improvement wherein said control piston means is adapted to receive a further pressure signal acting against said return means, and further comprising a remote control device adapted to deliver said further pressure signal with a selective pressure level so that said control valve means is moved to a position indicative of a desired input torque to said variable displacement pump;

said remote control device including a relief valve and a pilot pressure source, said pilot pressure source supplying fluid to said relief valve and said control piston means;

said relief valve being of a type to be electrohydraulically controlled.

12. Input torque control device set forth in claim 11 wherein said second piston area is a piston face of a spool of said control valve, and said first piston area is a piston face of an auxiliary piston acting upon said spool of said control valve.

13. Input torque control device for adjusting the input torque of a hydraulic variable displacement pump comprising:

means for changing said pump displacement including hydraulic servo motor means;

control valve means having an adjustable return means and a control piston means, said control valve being connected to said servo motor means;

a torque sensor delivering a hydraulic feedback pressure signal indicative of input torque and power to said variable displacement pump;

said feedback pressure signal acting upon said control piston means against the action of said return means, to move said control valve means when said pump displacement is being changed;

the improvement wherein said control piston means is adapted to receive a further pressure signal acting against said return means, and further comprising a remote control device adapted to deliver said further pressure signal with a selective pressure level so that said control valve means is moved to a position indicative of a desired input torque to said variable displacement pump, said control piston means including a first and a second piston having a first and a second piston area;

said feedback pressure signal being connected to said first piston area;

said further pressure signal from said remote control device being connected to said second piston area;

and wherein said first piston area is dimensionally different to said second piston area.

* * * * *